United States Patent [19]

Kernell

[11] 4,112,611

[45] Sep. 12, 1978

[54] TWIRLING TOY DEVICE

[76] Inventor: Samuel H. Kernell, 1052 Railton, Memphis, Tenn. 38111

[21] Appl. No.: 734,541

[22] Filed: Oct. 18, 1976

[51] Int. Cl.[2] ..... A63H 1/32

[52] U.S. Cl. ..... 46/47; 46/51

[58] Field of Search ..... 46/47, 51, 52, 74 D

[56] References Cited

U.S. PATENT DOCUMENTS

| | | | |
|---|---|---|---|
| 476,825 | 6/1892 | Schwartz | 46/47 |
| 2,109,788 | 3/1938 | Worst | 46/47 |
| 3,141,262 | 7/1964 | Burton | 46/47 |
| 3,580,580 | 5/1971 | Wark | 46/74 D |
| 3,708,911 | 1/1973 | Haschek | 46/47 |
| 3,939,601 | 2/1976 | Kernell | 46/47 |
| 3,946,518 | 3/1976 | Ylitato | 46/47 |

OTHER PUBLICATIONS

Playthings publication, Feb., 1959.

*Primary Examiner*—Louis G. Mancene
*Assistant Examiner*—Robert F. Cutting

[57] ABSTRACT

A toy device which includes a tubular member or broad band ring and a rod or stick intended to be grasped at the proximal end thereof by the user while engaging and manipulating the ring therewith. The stick has a relatively small diameter in comparison to the inner diameter of the ring to facilitate inducing a twirling action of the ring as it is circumposed about the stick at various selectable locations along the length thereof. The ring, preferably having a frustoconical profile, includes an inturned rim defining the small end thereof. The stick includes a pointed distal end, preferably having a rubber tip, for selectively engaging therewith particular portions of the ring, e.g., the rim, as the ring is being manipulated. A disc is included which may be removably joined to the ring, if desired, to supplement the feats of skill that may be practiced and enjoyed by the user. The disc is provided with a concentric aperture that is slightly larger than the small end of the ring and which receives the ring in a binding or gripping fashion.

16 Claims, 17 Drawing Figures

TWIRLING TOY DEVICE

BACKGROUND OF THE INVENTION

1. Field of the Invention

This invention relates to the field of twirling toy devices.

2. Description of the Prior Art

Various twirling or spinning toy devices which are used in conjunction with a stick have been patented heretofore. See, for example, the Ylitalo U.S. Pat. No. 3,946,518. Additionally, the applicant is the inventor of U.S. Pat. No. 3,939,601 relating to a spinning toy. Neither of the above patents suggest or disclose applicant's device.

SUMMARY OF THE INVENTION

The concept of the present invention is to provide a toy device which requires a certain amount of skill to properly operate, thus developing and/or improving dexterity on the part of the user. Several variations or embodiments of the concept are anticipated but in general terms the toy device of the present invention includes a tubular member or a broad band ring and a rod or stick intended to be grasped at the proximal end thereof by the user while engaging in manipulating the ring therewith. The stick preferably has a relatively small diameter in comparison to the inner diameter of the ring to facilitate inducing a twirling action of the ring as it is circumposed about the stick at various selectable locations along the length thereof. At least the interior surface of one embodiment of the ring is arranged so as to assume a frustoconical shape. The ring preferably includes an inturned rim which may optionally be formed of a rubberlike substance defining the small open end thereof. One embodiment of the rod or stick includes a pointed distal end, preferably having a rubberlike tip, for selectively engaging therewith particular portions of the ring, e.g., the rim, as the ring is being manipulated, while an alternate embodiment of the stick has a coating of a rubberlike substance over the entire surface thereof. The distal end of still another embodiment of the stick is peculiar in that it terminates with a right cylinder body portion having a protruding knifelike blade disposed perpendicular to the planar terminus of the body portion and having a transverse dimension which coincides with the diameter of the stick. A disc is included which may be removably joined to the ring, if desired, to supplement the feats of skill that may be practiced and enjoyed by the user. The disc is provided with a concentric aperture that is slightly smaller than at least a portion of the ring and which receives the ring in a binding or gripping fashion. Slits radiating outwardly from the concentric aperture establish a plurality of tabs for enhancing the gripping action of the disclike member. The joined ring and disc may optionally hereinafter be simply referred to as an assembly.

The following constitutes a description of certain of the feats of skill that may be practiced and perfected by using the ring and disc or the assembly:

(1) With the stick held upright, and the assembly set in a twirling motion, the assembly can be made to proceed to any level, high or low, to remain there, or to change levels, in complete defiance of gravity.

(2) The assembly can be made to climb the stick right on up to the very end, and hook on the tip, i.e., come to rest on the tip of the embodiment of the stick having the pointed distal end. It should be mentioned that these first two feats are accomplished with the assembly being placed in a position which may hereinafter be referred to as the upright position, i.e., with the smaller end of the assembly being directed away from the user.

(3) This feat is accomplished with the assembly being in an inverted position, i.e., with the smaller end of the assembly being directed toward the user. This feat is accomplished by holding the stick in a somewhat horizontally disposed position and starting the twirling motion therewith; then, as a certain amount of momentum is reached, the stick is pointed downwardly somewhat vertically toward the floor. It should be mentioned that this is one of the most difficult tricks, but if enough twirling motion is maintained, the toy will not slide down the stick but will tend to float in mid-air as it is twirling about the stick.

(4) This feat is an extension of the just-mentioned feat, number 3. In accomplishing this feat, the user allows the assembly to descend to the tip of the stick, i.e., by slowing down the twirling motion of the stock; subsequently, the assembly will cling to the sharpened tip portion with only a modicum of twirling effort.

(5) This feat is an extension of the above-described feats, numbers 3 and 4. Subsequent to mastering feats numbers 3 and 4, the user realizes that he has complete control of the assembly while it is twirling on the end of the stick. Subsequent to this level of proficiency, the user will be able to place the toy on a table or other horizontal plane or surface and then pick it up again with the point of the stick, i.e., all the while the assembly is twirling.

(6) This feat is an extension of the above-described feat, number 4. While the toy is twirling at the pointed tip of the downwardly directed stick, and while maintaining the twirling motion, the user brings the stick up and directs it somewhat vertically toward the ceiling. From this position, the assembly can be made to maintain its position, i.e., revolving about the sharpened end of the stick.

The following feats are performed by using only the tubular member or ring, i.e., the disc being removed therefrom:

(7) Place the ring on the pointed stick in the upright position, i.e., with the larger opening toward the user. In this position, feats such as those identified above as numbers 1 and 2 can be performed, but with the following important addition: after the ring has reached the sharpened area of the stick, the stick can be directed downwardly somewhat vertically and the ring will still hold the same position in defiance of gravity.

(8) This feat is an extension of the above-mentioned feat number 7, but the stick must be the embodiment having the rubberlike distal tip. The twirling motion of the ring is slowed somewhat while the stick is directed downwardly somewhat vertically toward the floor, then the ring will creep downwardly until the rim of the ring will fall off the rubber point, at which time the slanted wall of the ring will cling to the rubber tip portion of the stick for its support. The user can feel this when it hapens, but an observer will probably say that in his opinion the toy has not extended past the tip of the stick. To convince the observer the user may slowly raise the stick to point it somewhat vertically toward the ceiling while maintaining a twirling motion. Then, to the observer's surprise, the toy will in fact be hooked on the the end of the tip.

(9) This feat is accomplished with the ring being hooked onto the pointed tip of the stick with the larger opening facing downwardly. The user sets up a twirling motion and while maintaining this twirling motion, he slowly directs the stick downwardly toward the floor. The ring will not fall off the stick even though the stick is redirected in any number of positions, i.e., up, down, sideways, etc.

(10) This feat is an extension of the above-mentioned feat number 9. After the user realizes his control over the ring, he can place the ring on a table, or pick it up again at will with the twirling motion of the stick, i.e., all the while the ring is twirling.

DESCRIPTION OF THE PREFERRED EMBODIMENT

Figure 7:
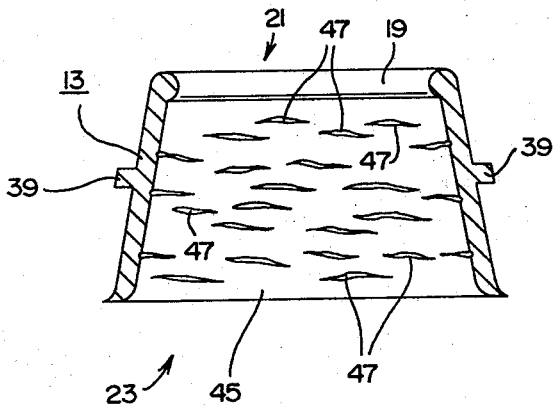
FIG. 7 is a sectional view taken as on the line VII—VII of FIG. 4.

Several embodiments of the instant concept are anticipated, however, The twirling toy device 11 of the present invention generally includes a tubular member or a broad band ring 13, and an elongated rod or stick 15 intended to be grasped at the proximal end 17 thereof by the user while engaging and manipulating the tubular member 13 therewith. The rod 15 has a substantial cylindrical shape thereto with the diameter thereof preferably being several times smaller than the inner diameter of the tubular member 13 to facilitate inducing a twirling action of the tubular member 13 as it is circumposed about the rod 15 at various selectable locations along the length thereof, i.e., FIG. 1 of the drawing clearly shows the tubular member or ring 13 circumposed about the rod 15 in only one of infinite selectable locations along the length of the rod 15 and the twirling action of the rod is indicated by showing only two positions 15' and 15'' therefor. The principal embodiment of the tubular member or ring 13 includes an inturned continuous rim 19 defining the terminous opening 21 of the first of the two remotely disposed open ends thereof, i.e., the second or other open end thereof being characterized by the numeral 23, as shown in FIG. 7 of the drawing. The principal embodiment of the rod 15 includes a pointed portion, as at 25, which preferably is pointed and defining the distal end 27 thereof, for selectively engaging the continuous rim 19 therewith as the tubular member 13 is being manipulated with the rod 15. However, if desired, the distal end 27 may be unpointed, i.e., right cylindrical or blunted, without departing from the spirit and scope of the present invention. Further, it will be understood that when the words substantially cylindrical are used herein as applied to the rod 15 it will be deemed to include not only an exact cylindrical shape but also anything approximating a cylinder, i.e., polygonal in transverse cross-section.

Figure 4:
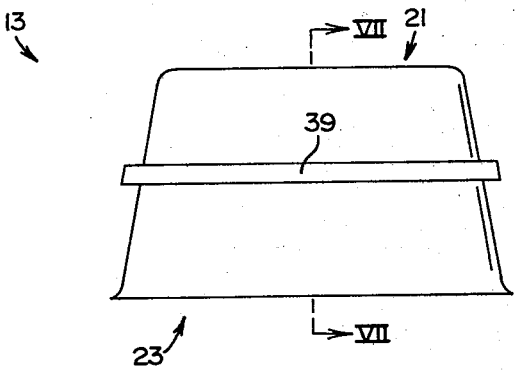
FIG. 4 is a side elevational view of the tubular member on an enlarged scale.

From FIGS. 4 and 7 of the drawing it may clearly be seen that the second open end 23 of the tubular member 13 is larger in diameter than is the first open end 21 thereof with at least the interior surface of the tubular member 13 being arranged so as to assume a substantially frustoconical shape. More specifically, the exterior shape of the tubular member 13 could be cylindrical with the interior surface being frustaconical. Although, in keeping with the concept of minimizing the overall weight of the tubular member 13, the preferred construction thereof is that it be extremely thin-walled. Thus, the inner and outer shape thereof would inherently be similar. However, it will be understood that either of the above techniques may be utilized in the construction of the tubular member 13 without departing from the spirit and scope of the present invention.

The device 11 includes a disclike member 29 which is provided with a concentric aperture 31 having a predetermined size which is substantially midway between the sizes of the first and second remotely disposed open ends 21, 23 of the tubular member 13 for enabling at least the first end 21 to be inserted within the concentric aperture 31 with the disclike member 29, thus being selectively and removably joined to the tubular member 13 during the manipulation thereof.

Figure 3:
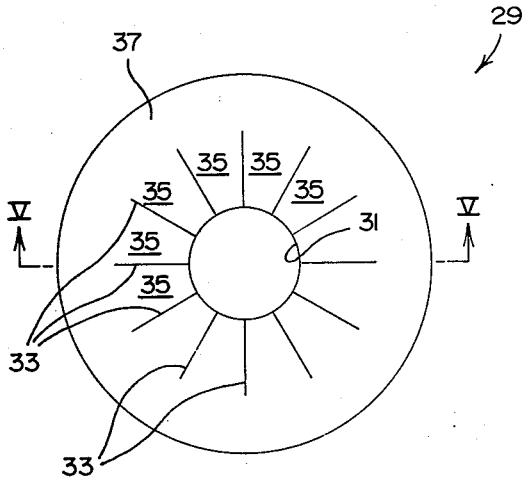
FIG. 3 is a top view of the disclike member on an enlarged scale.

The disclike member 29 preferably is formed from a somewhat pliant substance having a certain degree of stiffness thereto, e.g., polyurethane plastic or the like. From FIGS. 1 and 3 of the drawing it may clearly be seen that the disclike member 29 is provided with a plurality of radially aligned slits 33 extending outwardly from the concentric aperture 31 thus establishing a plurality of tab means, as at 35, for enhancing the gripping action of the disclike member 29 in a manner to be fully disclosed. The tab means 35 engages the wall of the tubular member 13 and, as clearly shown in FIG. 1, the tabs 35 yieldably bend away from the normal plane of the disclike member 29 as the tubular member 13 and the disclike member 29 are joined one to the other, i.e., the normal plane of the disclike member 29 is substantially as shown in FIG. 5 of the drawing for the portion character referenced by the numeral 37 thereof.

As previously mentioned, the weight of the device 11 is a factor in the performance thereof. Therefore, the thickness of the disclike member 29 is preferably minimal so as to hold the overall weight thereof to a minimum. In this regard, it should also be mentioned that the tubular member 13 preferably is formed from an extremely lightweight substance, e.g., aluminum or the like, with the thickness thereof being minimal to minimize the overall weight of the toy device 11.

Figure 1:
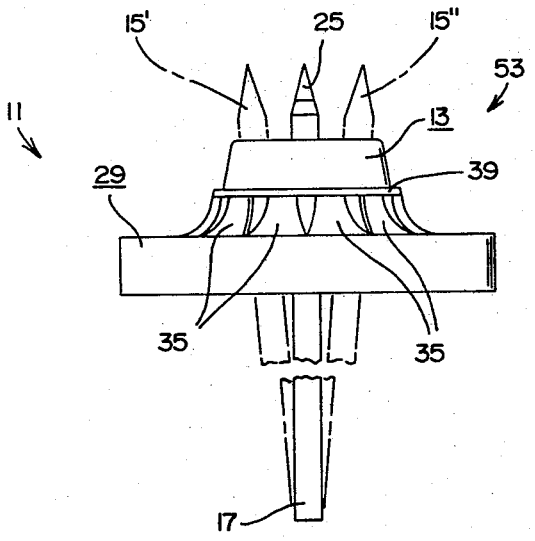
FIG. 1 is a front elevational view of the complete twirling toy device.

From FIGS. 1, 4 and 7 of the drawing it may be seen that the tubular member 13 includes stria means 39 circumferentially disposed about the exterior surface of the wall thereof for engaging and lockably constraining the tab means 35 to the tubular member 13 in a manner best depicted in FIG. 1 of the drawing. It should be understood that while the stria means 39 is shown as a ridge, the concept is intended to include a small groove or channel without departing from the spirit of the present invention. Similarly, the stria means 39 may be deleted from the tubular member 13 without departing from the spirit and scope of the present invention.

Figure 5:
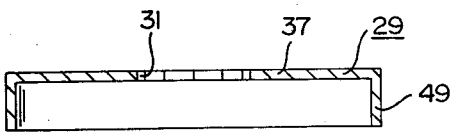
FIG. 5 is a sectional view taken as on the line V—V of FIG. 3.

From FIGS. 1 and 5 of the drawing it may be seen that the plurality of tab means 35 normally assume a position which is within the normal plane of the portion 37. However, when joining the disclike member 29 with the tubular member 13, the individual tabs 35 yieldably bend away from their normal planes thus the free ends of the tabs 35 pass over the stria means 39 and snap in place effectively joining the two members 13, 29 one with the other.

Figure 2:
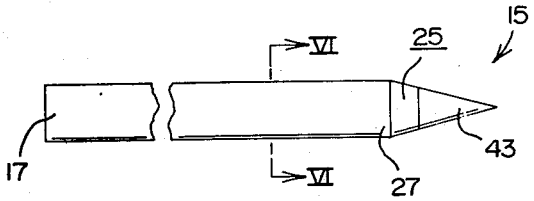
FIG. 2 is a side elevational view of the rod.

The rod 15 preferably is formed at least in part from a non-slick substance to impart a degree of gripping action of the pointed portion 25 with the tubular member 13 during the manipulation thereof. More specifically, the non-slick substance alluded to above preferably consists of a rubber base compound defining a core 41 extending along the length of the rod 15 with a tapered portion thereof, as at 43, being exposed, as clearly shown in FIG. 2 of the drawing, to constitute at least a part of the pointed portion 25. Applicant has found that a typical wood cased typewriter eraser suitably sharpened in a typical pencil sharpener, makes an ideal rod 15 which possesses all the above described features.

Figure 6:
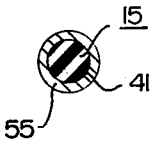
FIG. 6 is a sectional view taken as on the line IV—IV of FIG. 2.
Figure 8:
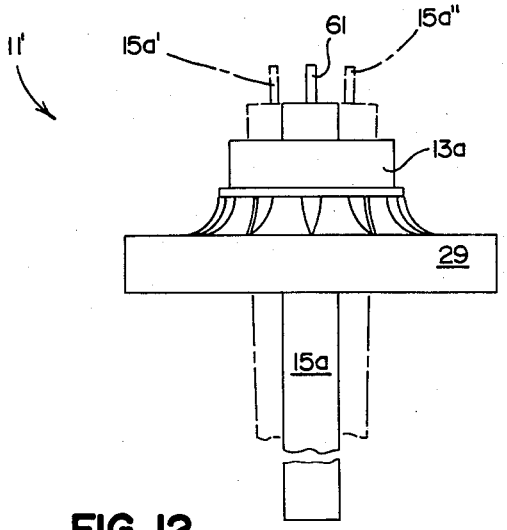
FIG. 8 is a front elevational view similar to FIG. 1 but depicting an alternate embodiment of the complete toy device.
Figure 9:
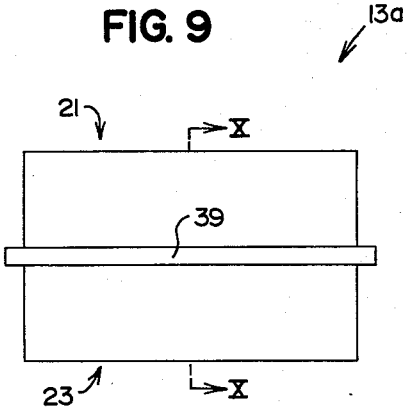
FIG. 9 is a side elevational view of an alternate embodiment of the tubular member.

The core 41 for the rod 15 preferably has a diameter which approximates ⅝ the diameter of the overall rod 15. FIG. 6 clearly shows the rod 15 having a relatively thin wooden case 55 and a rather large core 41. It will be appreciated by those skilled in the art that with this large core 41, pointed portion 25 will present a relatively long, tapered portion 43. In other words, a rather long, tapered portion 43 is deemed desirable in mastering the ten feats fully described above. However, the entire surface of the rod 15 may be suitably coated with a rubber cement or other such substance to establish a non-slick surface thereon if desired. This technique greatly simplifies the overall operation of the device 11 since more positive gripping action is thereby achieved during the entire twirling motion.

At least a portion of the interior surface, as at 45, of the tubular member 13 is provided with a non-slick surface, as indicated by the numeral 47, for imparting a degree of gripping action with the pointed portion 25 of the rod 15 as the tubular member 13 is being manipulated, i.e., the non-slick surface 47 has particular clinging or gripping action with the rubber base tapered portion 43. The non-slick surface 47 may be achieved by utilizing any one of several well known techniques, e.g., the surface 45 may simply be roughened with sandpaper or the like or it might be treated with a light coat of rubber cement, etc., all of which are intended to be anticipated by the concept herein disclosed.

From FIG. 5 of the drawing it may be seen that the disclike member 29 includes a flange portion 49 defining the circumference thereof with the flange portion 49 being substantially perpendicularly disposed with respect to the portion 29 or to the plane of the disclike member 29 per se. It should be mentioned that the flange portion 49 improves the performance of the joined members 13, 29 which constitutes an assembly 53 as shown in FIG. 1 of the drawing.

From FIGS. 8 through 14 of the drawings it may be seen that an alternate embodiment is herein disclosed which has a few variations from the principal embodiment. It should be understood that the following disclosure is intended to particularly disclose the features peculiar to the alternate embodiment. Therefore, structure having the same features as that structure previously disclosed will be character referenced by the same numeral as that previously disclosed. On the other hand, structure having similar characteristics will be identified with the same numeral followed by either a letter suffix or a prime suffix. Additionally, structure having little or no similarity to the previously disclosed structure will be character referenced by peculiar numerals. The twirling toy device 11' includes a tubular member or broad band ring **13*a*, and an elongated rod or stick 15*a*. The tubular member 13*a* includes a resilient washer-like member 57 establishing the previously disclosed continuous rim 19 defining the terminous opening 21 of the first of the two remotely disposed open ends of the member 13*a*. From FIG. 10 of the drawings it may be seen that the washer-like member 57 preferably is rectangular shaped in cross section. However, FIG. 11 of the drawings depicts still another embodiment of the tubular member which is characterized therein by the numeral 13** having the letter suffix *b*. The tubular member **13*b* distinguishes from the tubular member 13*a* in that the washer-like member 57'** is circular in cross section.

Figure 15:
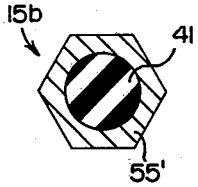
FIG. 15 is a view similar to FIGS. 6 and 14 but depicting still another embodiment of the rod.

From FIG. 15 of the drawings it may be seen that an alternate embodiment of the elongated rod is herein disclosed and is character referenced therein by the numeral 15 having the letter *b* suffix. The elongated rod **15*b* is characterized by having the perimeter shape and transverse cross section thereof defining a polygon, i.e., the perimeter shape defining a six sided polygon in FIG. 15 but eight-sided polygons and the like are also anticipated herein. It will be appreciated that the polygon shape of the transverse cross section imparts an audible noise when the tubular member 13 is caused to twirl along the length thereof, i.e., the tubular member 13** preferably being formed from aluminum or the like.

Figure 12:
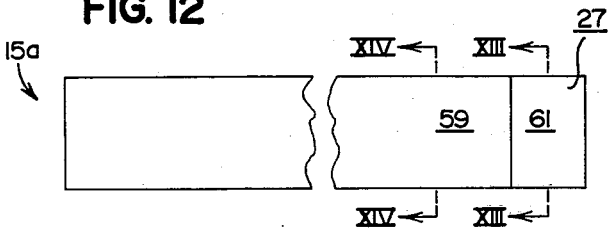
FIG. 12 is a side elevational view similar to FIG. 2 but depicting an alternate embodiment of the rod.
Figure 10:
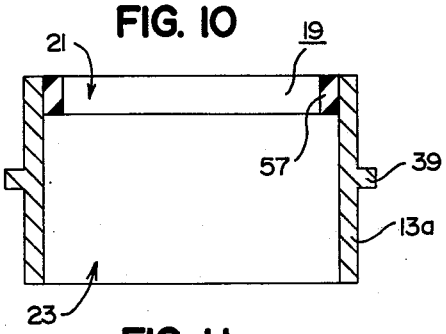
FIG. 10 is a sectional view taken as on the line X—X of FIG. 9.
Figure 11:
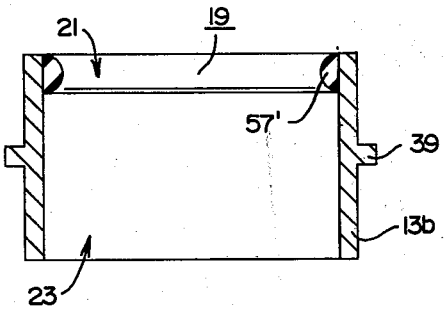
FIG. 11 is a view similar to FIG. 10 but depicting still another embodiment of the tubular member.
Figure 13:
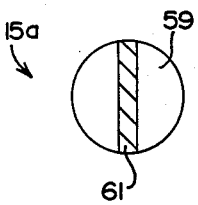
FIG. 13 is a sectional view taken as on the line XIII—XIII of FIG. 12.
Figure 14:
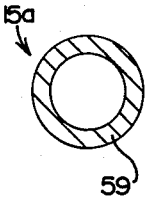
FIG. 14 is a sectional view taken as on the line XIV—XIV of FIG. 12.

From FIGS. 12 through 14 of the drawings it may be seen that still another embodiment of the elongated rod is herein disclosed and is character referenced therein by the numeral 15 having the letter a suffix. The distal end 27 of the elongated rod **15*a* terminates with a right cylinder body portion 59. However, a knifelike blade member 61 is included as clearly shown in FIGS. 8, 12 and 13, with the blade member 61 being disposed perpendicular to the planar surface of the terminus of the body portion 59 and having a transverse dimension which coincides with the diameter of the elongated rod 15*a*. It should also be mentioned that the elongated rod 15*a* preferably is tubular as clearly shown in FIG. 14 of the drawing. In fact, applicant has found that a typical transparent case normally used for containing a pair of replacement windshield wiper blades possesses the desirable characteristics herein disclosed for the elongated rod 15***a*.

Figure 16:
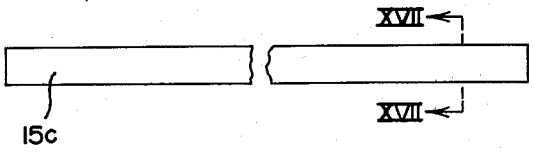
FIG. 16 is a side elevational view similar to FIGS. 2 and 12 but depicting still another embodiment of the rod.
Figure 17:
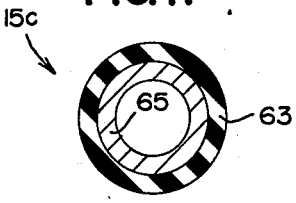
FIG. 17 is a sectional view taken as on the line XVII—XVII of FIG. 16.

From FIGS. 16 and 17 of the drawings it may be seen that still another embodiment of the elongated rod is herein disclosed and is character referenced therein by the numeral 15 having the letter *c* suffix. The elongated rod 15*c* is also tubular being open at both the proximal and distal ends thereof which are squared off as shown in FIG. 16 of the drawings. The elongated rod 15*c* includes coating means 63, e.g., a thin coating of rubber cement or the like, for providing optimum gripping action with the tubular means 13, 13*a*, or 13*b*, as the tubular means is caused to twirl at various selectable locations along the length of the elongated rod 15*c*. A body 65 of the elongated rod 15*c* may be formed in any well-known manner, e.g., rolled fiberboard or the like, to provide a rather rigid wand or rod. In fact, applicant has found that the horizontal member of a typical coat hanger or rack of the type having a wire frame supporting the cardboard horizontal member usually coated with a sticky substance to prevent trousers from falling therefrom possesses all of the desirable characteristics of the elongated rod 15*c* as herein disclosed.

Although the invention has been described and illustrated with respect to preferred embodiments thereof, it is to be understood that it is not to be so limited since changes and modifications may be made therein which are within the full intended scope of the invention.

I claim:

1. A toy device comprising an elongated rod having a distal end and a proximal end, and tubular means for encircling said elongated rod in a twirling motion when said rod is manipulated to cause said tubular means to twirl at various selectable locations along the length thereof, said rod having a substantial cylindrical shape thereto, and said rod being unobstructed at the distal end thereof for movement of said tubular means onto and off of said distal end, said tubular means having first and second remotely disposed open ends and having a substantially unobstructed interior for allowing said elongated rod to selectively extend completely therethrough.

2. The toy device as set forth in claim 1 in which said first open end of said tubular means has a terminous opening, in which said tubular means includes an inturned continuous rim defining said terminus opening of said first open end thereof, and in which said rod includes at the distal end thereof a pointed portion.

3. The toy device as set forth in claim 1 in which at least said distal end of said rod is formed at least in part from a non-slick substance to impart a degree of gripping action of the surface of said distal end with said tubular means during the manipulation thereof.

4. The toy device of claim 3 in which said distal end of said rod is pointed.

5. The toy device as set forth in claim 1 in which at least a portion of the interior of said tubular means is provided with a non-slick surface for imparting a degree of gripping action with said rod as said tubular means is being manipulated.

6. The toy device as set forth in claim 1 in which said tubular means is formed from an extremely lightweight substance with the thickness thereof being minimal to minimize the overall weight thereof.

7. The toy device as set forth in claim 1 in which said elongated rod includes coating means for providing optimum gripping action with said tubular means as said tubular means is caused to twirl at various selectable locations along the length of said elongated rod.

8. A toy device comprising an elongated rod having a distal end and a proximal end, tubular means for encircling said elongated rod in a twirling motion when said rod is manipulated to cause said tubular means to twirl at various selectable locations along the length thereof, said tubular means having first and second remotely disposed open ends, said first open end of said tubular means having a terminus opening, said rod having a substantial cylindrical shape thereto, and said rod being unobstructed at the distal end thereof for movement of said tubular means onto and off of said distal end, tubular means including an inturned continuous rim defining said terminus opening of said first open end thereof and said rod including at the distal end thereof a pointed portion, said second open end of said tubular means being larger in diameter than said first open end thereof with at least the interior surface of said tubular means assuming a frustoconical shape, and a disclike member which is provided with a concentric aperture having a predetermined size which is substantially midway between the sizes of said first and second remotely disposed open ends of said tubular means for enabling at least said first open end of said tubular means to be inserted within said concentric aperture with said disclike member thusly being selectably and removably joined to said tubular means during the manipulation thereof.

9. The toy device as set forth in claim 8 in which said disclike member is formed from a somewhat pliant substance having a certain degree of stiffness thereto and which is provided with a plurality of radially aligned slits extending outwardly from said concentric aperture thus establishing a plurality of tab means for enhancing the gripping action of said disclike member, said tab means engaging the wall of said tubular means and yieldably bending away from the normal plane of said disclike member as said tubular means and said disclike member are joined one to the other.

10. The toy device as set forth in claim 9 in which said tubular means includes stria means circumferentially disposed about the exterior surface of the tapered wall thereof for engaging and lockably constraining said tab means to said tubular means.

11. The toy device as set forth in claim 8 in which said disclike member includes a flange portion defining the circumference thereof with said flange portion being substantially perpendicularly disposed with respect to the plane of said disclike member.

12. The toy device as set forth in claim 8 in which said disclike member is formed from a polyurethane plastic with the thickness thereof being minimal to minimize the overall weight thereof.

13. A toy device comprising an elongated rod having a distal end and a proximal end, and tubular means for encircling said elongated rod in a twirling motion when said rod is held adjacent said proximal end thereof and manipulated to cause said tubular means to twirl at various selectable locations along the length thereof, said rod having a substantial cylindrical shape thereto, said rod being unobstructed at said distal end thereof for movement of said tubular means onto and off to said distal end, said tubular means being opened at each end and having a substantially unobstructed interior for allowing said elongated rod to selectively extend completely therethrough, at least said distal end of said rod being formed at least in part from a non-slick substance to impart a degree of gripping action of the surface of said distal end with said tubular means during the manipulation thereof, said distal end of said rod being pointed, said non-slick substance consisting of a rubber base compound defining a core extending along the length of said rod with a tapered portion thereof being exposed to constitute at least a pair of said pointed portion of said rod.

14. A toy device comprising an elongated rod having a distal end and a proximal end, and tubular means for encircling said elongated rod in a twirling motion when said rod is manipulated to cause said tubular means to twirl at various selectable locations along the length thereof, said rod having a substantial cylindrical shape thereto, and said rod being unobstructed at the distal end thereof for movement of said tubular means onto and off of said distal end, said tubular means including a resilient washer-like member establishing a continuous rim defining the terminous opening of the first of the two remotely disposed open ends thereof.

15. A toy device comprising an elongated rod having a distal end and a proximal end, and tubular means for encircling said elongated rod in a twirling motion when said rod is manipulated to cause said tubular means to twirl at various selectable locations along the length thereof, said rod having a substantial cylindrical shape thereto, and said rod being unobstructed at the distal end thereof for movement of said tubular means onto and off of said distal end, the perimeter shape of said elongated rod being polygonal in transverse cross section.

16. A toy device comprising an elongated rod having a distal end and a proximal end, tubular means for encircling said elongated rod in a twirling motion when said rod is manipulated to cause said tubular means to twirl at various selectable locations along the length thereof, said rod having a substantial cylindrical shape thereto, and said rod being unobstructed at the distal end thereof for movement of said tubular means onto and off of said distal end, the distal end of said elongated rod terminating with a right cylinder body portion, and a knifelike blade member being disposed perpendicular to the planar surface of the terminus of said body portion and having a transverse dimension which coincides with the diameter of said elongated rod.

* * * * *